US012466674B2

(12) United States Patent
Kawarago et al.

(10) Patent No.: US 12,466,674 B2
(45) Date of Patent: Nov. 11, 2025

(54) SHAFT AND IMAGE FORMING APPARATUS

(71) Applicant: CANON KABUSHIKI KAISHA, Tokyo (JP)

(72) Inventors: Atsushi Kawarago, Shizuoka (JP); Takeshi Tsukahara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 18/176,401

(22) Filed: Feb. 28, 2023

(65) Prior Publication Data

US 2023/0331501 A1 Oct. 19, 2023

(30) Foreign Application Priority Data

Apr. 18, 2022 (JP) ..... 2022-068356

(51) Int. Cl.
*B65H 3/06* (2006.01)
*B65H 3/52* (2006.01)

(52) U.S. Cl.
CPC ..... *B65H 3/5261* (2013.01); *B65H 3/0669* (2013.01); *B65H 2403/732* (2013.01)

(58) Field of Classification Search
CPC ..... B65H 3/0676; B65H 3/0684; B65H 3/06; B65H 2403/732; B65H 3/0669; B65H 3/5261
See application file for complete search history.

(56) References Cited

U.S. PATENT DOCUMENTS 5,630,580 A * 5/1997 Tsao ..... B41J 13/103 198/577
5,873,441 A * 2/1999 Tsujishita ..... F16D 41/22 192/93 A
5,884,860 A * 3/1999 Ishikawa ..... B65H 23/06 242/422.4
9,851,692 B2 12/2017 Tsukahara ..... G03G 21/18
10,253,866 B2 4/2019 Tsukahara et al. ..... F16H 55/17
2004/0251595 A1* 12/2004 Sheng ..... B65H 3/06 271/121
2019/0367302 A1* 12/2019 Inui ..... B65H 3/0669

FOREIGN PATENT DOCUMENTS

CA 2588431 * 10/2008
JP H06-147234 5/1994
JP 2005-320132 * 11/2005
JP 2015-224774 12/2015

* cited by examiner

*Primary Examiner* — Thomas A Morrison
(74) *Attorney, Agent, or Firm* — Venable LLP

(57) ABSTRACT

A shaft on which a torque limiter is mounted includes a rotation restricting portion. The rotation restricting portion is inserted into and engaged with an engaging portion of the torque limiter. The rotation restricting portion is provided with an outer circumferential portion which is projected in an outer diameter direction from an outer circumference of the shaft and of which an outer circumferential surface is formed parallel with an outer circumferential surface of the shaft and an engaging portion connected to the outer circumferential portion and engaging with the engaging portion of the torque limiter. The engaging portion of the rotation restricting portion is provided with a tip portion of a R shape opposing the engaging portion of the torque limiter, and a width thereof in a direction perpendicular to an inserting direction into the engaging portion of the torque limiter is a width capable of being inserted into the engaging portion of the torque limiter.

3 Claims, 5 Drawing Sheets

(a)

(b)

(b)

(a)

(b)

(a)

SHAFT AND IMAGE FORMING APPARATUS

FIELD OF THE INVENTION AND RELATED ART

This invention relates to a shaft and an image forming apparatus equipped with the shaft.

Conventionally, various fixed and rotatable shafts are used in a driving portion of image forming apparatus adopting an electrophotographic method, and gears, cams, clutches, torque limiters, etc. are attached to the fixed and the rotatable shafts. For example, in order to restrict a rotation of the gears or cams mounted on the shaft, shapes including a plain portion such as D-cut shape and I-cut shape are used on a portion of the shaft. In addition, when standardized general-purpose parts such as clutches and torque limiters are mounted on the shaft, a method for restricting the rotation by using a parallel pin on the shaft is generally used.

For example, in Japanese Patent Application Laid-Open No. H06-147234, a torque limiter with a variable torque value is proposed by fixing a shape constituting a part of the torque limiter to the shaft. When a holding shaft is provided with a shape that engages with a torque limiter, it requires a combination of multiple parts and machining such as cutting and press fitting, which increases a cost. Therefore, parallel pins are widely used in order for the holding shaft to restrict a rotation against the general-purpose parts in general.

SUMMARY OF THE INVENTION

The purpose of the present invention is to provide a rotatable shafts capable of restricting rotations without the use of parallel pins.

In order to solve the problems mentioned above, the present invention includes the following configuration.

A shaft on which a torque limiter, applying a constant rotational load to a rotatable member attached to the torque limiter during rotation of the rotatable member, is mounted, the shaft comprising: a rotation restricting portion inserted into and engaged with an engaging portion of the torque limiter to restrict rotation of the torque limiter, wherein the rotation restricting portion is provided with an outer circumferential portion which is projected in an outer diameter direction from an outer circumference of the shaft and of which an outer circumferential surface is formed parallel with an outer circumferential surface of the shaft, and an engaging portion connected to the outer circumferential portion and engaging with the engaging portion of the torque limiter, and wherein the engaging portion of the rotation restricting portion is provided with a tip portion of a R shape opposing the engaging portion of the torque limiter, and a width thereof in a direction perpendicular to an inserting direction into the engaging portion of the torque limiter is a width capable of being inserted into the engaging portion of the torque limiter.

Further features of the present invention will become apparent from the following description of exemplary embodiments with reference to the attached drawings.

DESCRIPTION OF THE EMBODIMENTS

Hereinafter, embodiments of the present invention will be described in detail with reference to the drawings.

[Embodiment]

[Configuration of Image Forming Apparatus]

Figure 1:
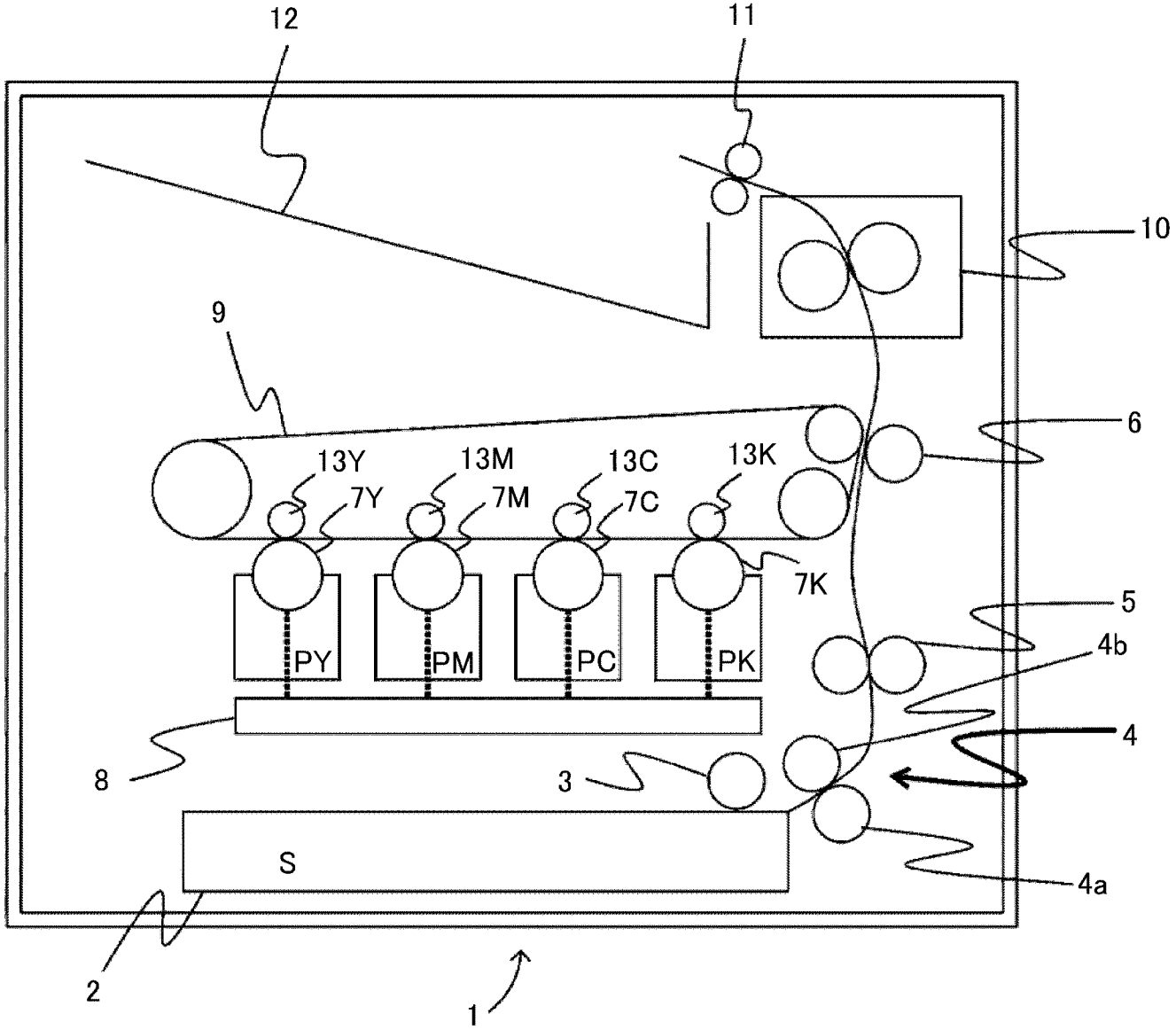
FIG. 1 is a schematic cross-sectional view of a configuration of an image forming apparatus of an embodiment.

FIG. 1 is a cross-sectional view of an image forming apparatus 1 to which the present invention is applied. In FIG. 1, the image forming apparatus 1 is equipped with process cartridges P (PY, PM, PC, PK) corresponding to toners of yellow (Y), magenta (M), cyan (C), and black (K). Configurations and image forming operations of each process cartridges PY, PM, PC, and PK are identical, except that the colors of the toners are different. In addition, Y, M, C, and K appended to the end of the reference numerals of members comprising the process cartridges P indicate that the colors of the toner are yellow (Y), magenta (M), cyan (C), and black (K), respectively. Similarly, Y, M, C, and K appended to the end of the reference numerals of members other than process cartridges P indicate that those are members corresponding to process cartridges P with toner colors of yellow (Y), magenta (M), cyan (C), and black (K), respectively. In the following, the Y, M, C, and K appended to the end of the reference numerals of the members are omitted, except when referring to specific members of the process cartridges P.

In each process cartridges P, after a photosensitive drum 7 is charged to a uniform surface potential by a charging portion (not shown), an electrostatic latent image is formed on the photosensitive drum 7 by a laser beam (indicated by dotted lines in the figure) emitted from a laser scanner 8. Then the toner is adhered to the electrostatic latent image formed on the photosensitive drum 7 by a developing portion (not shown) to form a toner image. The toner images formed on the photosensitive drum 7 of each process cartridges P is sequentially transferred to an intermediary transfer belt 9 by each primary transfer rollers 13. The toner images transferred on the intermediary transfer belt 9 moves to a secondary transfer nip portion where the intermediary transfer belt 9 and a secondary transfer roller 6 come into contact.

As shown in FIG. 1, at the bottom of the image forming apparatus 1, a sheet feeding cassette 2, which accommodates sheets S as a recording material, is set detachable from and attachable to the image forming apparatus 1. The sheet S accommodated in the sheet feeding cassette 2 are separated and conveyed one by one by a sheet feeding roller 3 and a separating roller pair 4, and then conveyed to the secondary transfer roller 6 by a conveying roller pair 5.

In synchronization with the image forming operation in the process cartridges P described above, the sheet S fed from the paper cassette 2 is conveyed to the secondary transfer roller 6, and the toner image formed on the intermediary transfer belt 9 is transferred to the sheet S in the secondary transfer nip portion. After the toner image is transferred, the sheet S is conveyed to a fixing device 10. In the fixing device 10, the toner image transferred to the sheet S is heated and pressurized to fix the image on the sheet S.

The sheet S on which the toner image is fixed is discharged to a discharge tray 12 by a discharging roller pair 11.

Incidentally, in FIG. 1, a torque limiter 20 (described below) is mounted on a holding shaft 30 (described below) of a separating roller 4*a* which is a rotatable member located on the lower side of a pair of the separating roller pair 4 (4*a*, 4*b*). Incidentally, the torque limiter 20 is a component that constitutes a function to transmit or shut off a driving force of the holding shaft 30 to the separating roller 4*a* according to a rotational load (torque) applied from the separating roller 4*b* to the separating roller 4*a* of the separating roller pair 4.

Figure 5:
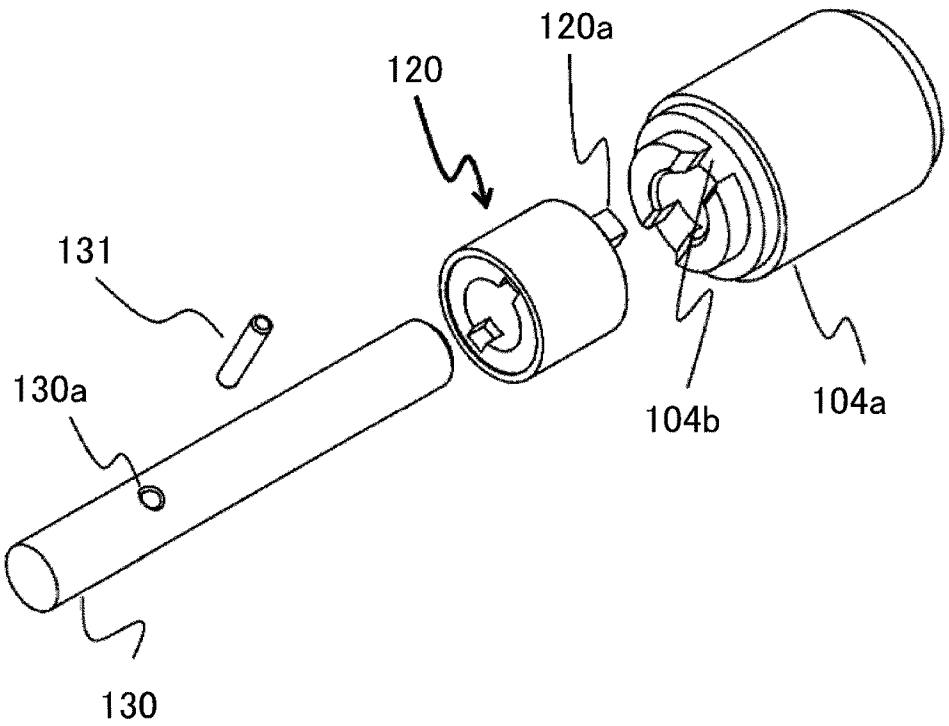
FIG. 5, part (a) and part (b), is a schematic view of the configuration of a torque limiter in a comparative example.
Figure 5:
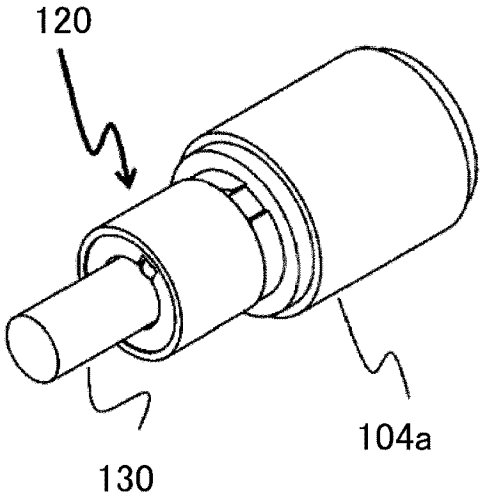

Here, a comparative example is described. FIG. 5(*a*) is a perspective view of a conveying roller 104*a* to which a torque limiter 120 of the comparative example is attached. In FIG. 5(*a*), a rotation of the torque limiter 120 is restricted by using a parallel pin 131 to a holding shaft 130. FIG. 5(*b*) is an exploded perspective view of the component shown in FIG. 5(*a*) disassembled into each of members. As shown in FIG. 5(*b*), the component shown in FIG. 5(*a*) is constituted of the holding shaft 130, the torque limiter 120, and the conveying roller 104*a*.

As shown in FIG. 5(*b*), a conveying roller engaging portion 104*b* of the conveying roller 104*a*, to which torque is applied by the torque limiter 120, is engaged with a torque limiter engaging portion 120*a* provided on the conveying roller 104*a* side of the torque limiter 120. On the other hand, a surface opposite to the conveying roller 104*a* side of the torque limiter 120 engages with the holding shaft 130 via the parallel pin 131 inserted into a hole 130*a* for the parallel pin in the holding shaft 130. Therefore, it is configured that when the conveying roller 104*a* rotates in a state where the rotation of the holding shaft 130 is restricted, a preset torque is applied to the conveying roller 104*a* by a mechanism (not shown) provided inside the torque limiter 120.

However, in cases where parallel pins are used to restrict a rotation, it is necessary to provide a hole for the parallel pin to be inserted in the holding shaft in a direction perpendicular to an axial direction of the holding shaft. Therefore, it was necessary to process a secondary processing such as cutting for the holding shaft. In addition, when assembling the holding shaft to general-purpose parts, it is also necessary to assemble the holding shaft to general-purpose parts such as torque limiters with the parallel pin held in a predetermined position after the parallel pin is inserted into the holding shaft, which increases a cost during assembly. Therefore, reducing machining costs and assembly costs is a problem to be solved.

[Torque Limiter]

Figure 2:
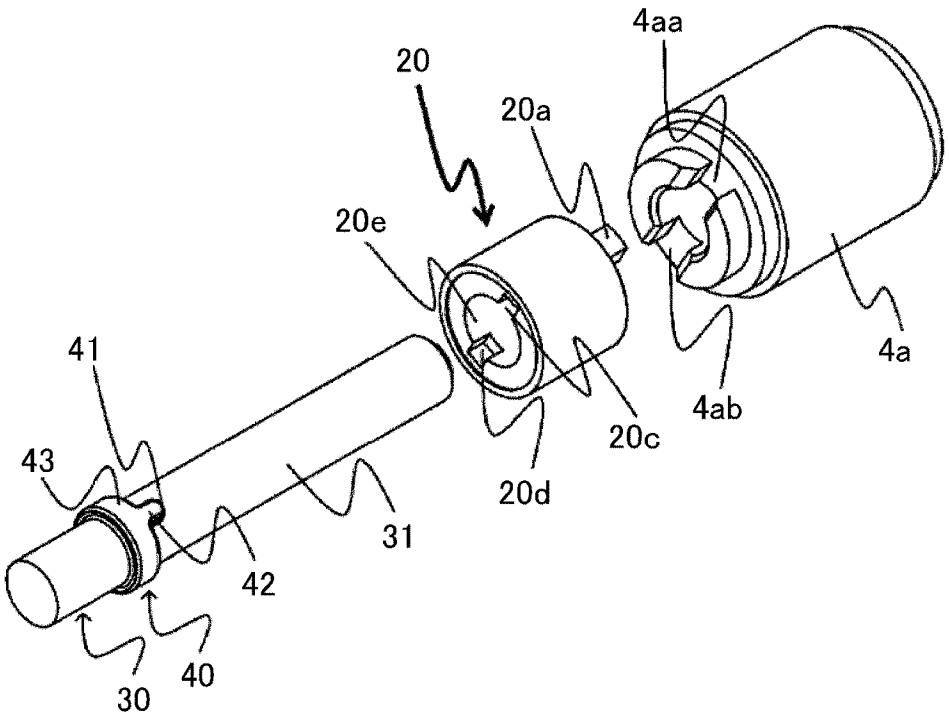
FIG. 2, part (a) and part (b), is a perspective view illustrating a configuration of a roller to which the torque limiter is attached in the embodiment.
Figure 2:
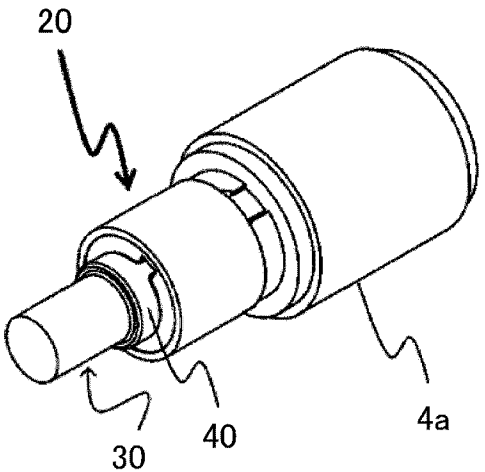

FIG. 2(*a*) is a perspective view of the separating roller 4*a* with the torque limiter 20 of the embodiment as described in FIG. 1 being attached. In FIG. 2(*a*), one end portion of the torque limiter 20 is engaged with the separating roller 4*a*, and the other end portion side of the torque limiter 20 is engaged, via a rotation restricting portion 40 restricting a rotation of the torque limiter 20, with the holding shaft 30 on which the rotation restricting portion 40 is provided.

FIG. 2(*b*) is an exploded perspective view illustrating a state before assembling the separating roller 4*a*, the torque limiter 20, and the holding shaft 30 shown in FIG. 2(*a*) to illustrate an engagement relationship. As shown in FIG. 2(*b*), the separating roller 4*a* includes an engaging portion 4*aa* and an engaging portion 4*ab*, which are cut-away portions for engaging with the torque limiter 20. On the other hand, the torque limiter 20 also includes an engaging portion 20*a* and an engaging portion 20*b* (not shown in FIG. 2(*b*)), which are projected portions for engaging with the separating roller 4*a*. The torque limiter 20 is attached to the separating roller 4*a* by engaging the engaging portion 4*aa* and the engaging portion 4*ab* of the separating roller 4*a* with the corresponding engaging portion 20*a* and the corresponding engaging portion 20*b* of the torque limiter 20.

In addition, as shown in FIG. 2(*b*), the torque limiter 20 includes an engaging portion 20*c* and an engaging portion 20*d*, which are cut-away portions (groove portions) for engaging with the holding shaft 30. The holding shaft 30 includes the rotation restricting portion 40 with two protruding portions which are engaging portions corresponding to the engaging portion 20*c* and the engaging portion 20*d* of the torque limiter 20. The rotation restricting portion 40 includes an outer circumferential portion 43 protruding in on the holding shaft 30 and two protruding portions in an inserting direction into the torque limiter 20 that are connected to the outer circumferential portion. The protruding portion of the rotation restricting portion 40 of the holding shaft 30 shown in FIG. 2(*b*) is an engaging portion engaging with the engaging portion 20*c* of the torque limiter 20. Incidentally, the engaging portion which is the other protruding portion of the rotation restricting portion 40 of the holding shaft 30, which engages with the engaging portion 20*d* of the torque limiter 20, is not shown in FIG. 2(*b*). And the holding shaft 30 is attached to the torque limiter 20 by engaging the engaging portions of the two protruding portions of the rotation restricting portion of the holding shaft 30 with the engaging portion 20*c* and the engaging portion 20*d* of the torque limiter 20.

The separating roller 4*a*, to which the torque limiter 20 of the embodiment is attached, operates as follows when the sheet S accommodated in the sheet feeding cassette 2 is fed from the paper feeding roller 3 by the torque limiter 20 in a state where a rotation of the holding shaft 30 is restricted. That is, when a single sheet S enters a nip portion of the separating roller pair 4, torque of the separating roller 4*b* (a first rotatable member) is transmitted to the separating roller 4*a* (a second rotatable member) via a frictional force of the paper S, and torque more than a predetermined amount is applied to the separating roller 4*a*. This interrupts a transmission of torque from the torque limiter 20 to the separating roller 4*a*, and the separating roller 4*a* follows a rotation of the separating roller 4*b* and rotates in a conveyance direction of the sheet S.

On the other hand, when the two sheets S enter the nip portion of the separating roller pair 4, torque of the separating roller 4*b* is not transmitted due to slippage between the two sheets S. Therefore, no more torque than the predetermined amount is applied to the separating roller 4*a*, and a rotation of the separating roller 4*a* is restricted according to a constant rotational load of the torque limiter 20. As a result, the sheet S contacting the separating roller 4*a* is separated from the sheet S contacting the separating roller 4*b*, and the sheet S is separated one by one and conveyed to the conveying roller pair 5. Incidentally, the torque limiter 20, also for engaging with the separating roller 4*a*, is a general method widely used, therefore, a detailed description is omitted.

[Configuration of Rotation Restricting Portion]

Figure 3:
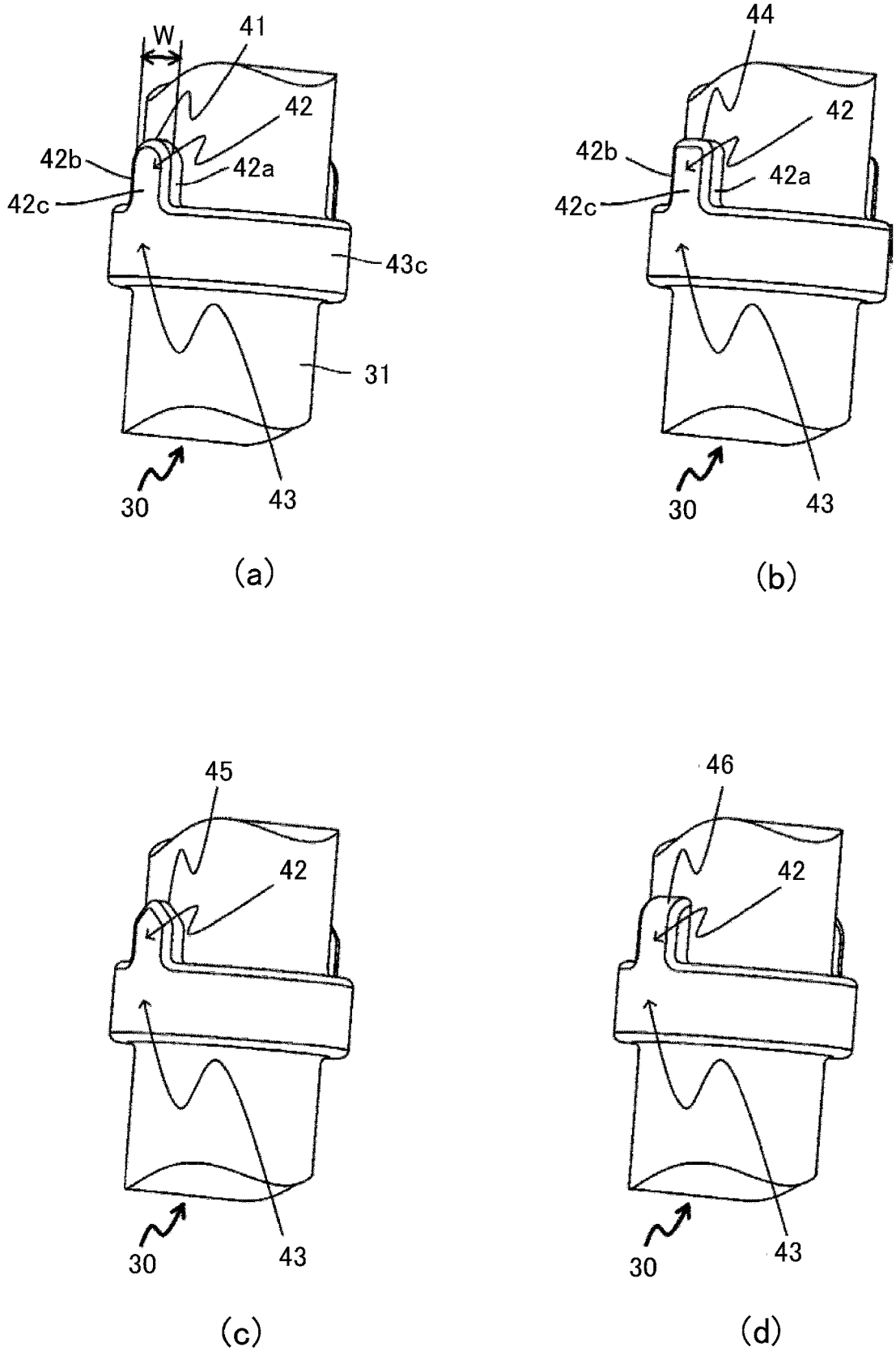
FIG. 3, part (a), part (b), part (c) and part (d), is a schematic view illustrating a rotation restricting portion of a holding shaft in the embodiment.

Next, a configuration of the rotation restricting portion 40 provided on the holding shaft 30 is explained with reference to FIG. 3. FIG. 3(*a*) is an enlarged perspective view of an area around the rotation restricting portion 40 provided on the holding shaft 30 in the embodiment shown in FIG. 2. As shown in FIG. 3(*a*), the outer circumferential portion 43 is formed on the holding shaft 30 projected from a shaft diameter portion 31 of the holding shaft 30 that is inserted into a through hole 20*e* (FIG. 2(*b*)) of the torque limiter 20 in an outer diameter direction and goes around the outer circumference of the holding shaft 30.

Further, the rotation restricting portion 40 includes the two protruding portions projected in the inserting direction toward the engaging portion 20*c* and the engaging portion 20*d* of the torque limiter 20 that are in continuation of (connected with) the outer circumferential portion 43.

[Configuration of Protruding Portion]

The protruding portion is constituted of an engaging portion 42, which is connected (continuous) with the outer circumferential portion 43, and a tip portion 41, which has a semicircular shape, connected (continuous) with the engaging portion 42 and disposed at a tip in the inserting direction into the engaging portion of the torque limiter 20. The protruding portion whose overall configuration is shown in FIG. 3(*a*) (near side in the figure) is the protruding portion corresponding to the engaging portion 20*c* of the torque limiter 20. In addition, the other protruding portion (back side in the figure), whose shape is only partially visible in FIG. 3(*a*), is the protruding portion corresponding to the engaging portion 20*d* of the torque limiter 20. Incidentally, the protruding portion that is only partially visible in FIG. 3(*a*) (back side in the figure) includes the same configuration as the protruding portion whose entire configuration is shown in FIG. 3(*a*) (near side in the figure). The two protruding portions are disposed in opposite positions with respect to the center (centerline) of the holding shaft 30.

[Configuration of Engaging Portion]

The engaging portion 42 is constituted of three planes, a plane 42*a*, a plane 42*b*, and a plane 42*c* as shown in FIG. 3(*a*). The plane 42*c* is connected to and at the same height as the outer circumferential portion 43*c* of the outer circumferential portion 43. The plane 42*a* and the plane 42*b* disposed on both sides of the plane 42*c* in the insertion direction into the torque limiter 20*c* are planes which are substantially parallel to the axial direction of the holding shaft 30. In addition, a width W (distance) between the two planes, the plane 42*a* and the plane 42*b*, has the same dimension as a diameter of the parallel pin (FIG. 5(*b*)) used for general rotation restricting of the torque limiter 20 described above. Therefore, the width perpendicular to the inserting direction of the engaging portion 42 into the torque limiter 20 (the width W between the plane 42*a* and the plane 42*b*) is the width capable for the engaging portion 42 to be inserted into the engaging portion 20*c* of the torque limiter 20. A corner portion where the plane 42*c*, the plane 42*a* and the plane 42*b* are connected are chamfered and has an edge-free shape. Similarly, a corner portion of the outer circumferential surface 43*c* of the outer circumferential portion 43 is also chamfered.

(Configuration of Tip Portion)

Next, a configuration of the tip portion 41 is described. The tip portion 41 has a cylindrical shape, in the inserting direction into the engaging portion 20*c* of the torque limiter 20, with a semicircular R shape whose diameter is the same dimension as the width W between the plane 42*a* and the plane 42*b*. Therefore, the tip portion 41 has a shape such that a volume of a part of the tip of the protruding portion (the engaging portion 42) decreases in the inserting direction into the torque limiter 20 of the holding shaft 30. In addition, a corner portion where a semicircular surface where the plane 42*a* and the plane 42*b* of the engaging portion 42 are connected and the plane 42*c* of the engaging portion 42 are connected is chamfered and has an edge-free shape, as same as the engaging portion 42.

The tip portion 41 and the engaging portion 42 have shapes described above. Therefore, when the holding shaft 30 and the torque limiter 20 are engaged, the protruding portion of the rotation restricting portion 40 has the same shape as the holding shaft 130 with the parallel pin 131 attached and the torque limiter 120 are engaged in the comparative example shown in FIG. 5. Therefore, the rotation restricting portion 40 on the holding shaft 30 in the embodiment has the same function as the parallel pin 131 which is a rotation restricting portion shown in FIG. 5 of the comparative example.

(Other Shapes of Tip Portion)

The holding shaft 30 with the rotation restricting portion 40 in the embodiment is formed by a forging process. As mentioned above, the shape of the tip portion 41 of the rotation restricting portion 40 of the embodiment shown in FIG. 3(*a*) has the semicircular R shape. The R shape makes it easier to supply the material to be forged to the engaging portion 42 by reducing the volume of the tip portion 41 as the shape of the tip portion 41 extends in an elongation direction (inserting direction into the torque limiter 20) when forging the holding shaft 30.

Incidentally, the shape of the tip portion 41 is not limited to the shape shown in FIG. 3(*a*). For example, FIG. 3(*b*) illustrates an example where a shape of a plane in the inserting direction into the torque limiter 20 of a tip portion 44 is flat. Incidentally, a corner portion which is a tip portion where the plane of the tip portion 44, the plane 42*a* and the plane 42*b* of the engaging portion 42 are connected has an R shape to facilitate supplying the material to be forged to the engaging portion 42.

In addition, FIG. 3(*c*) illustrates an example where a shape in the inserting direction into the torque limiter 20 of a tip portion 45 is triangular prism which is substantially triangular. Incidentally, a tip in the inserting direction into the engaging portion 20*c* of the torque limiter 20 of the tip portion 45 with the shape of triangular prism has an R shape to facilitate supplying the material to be forged to the engaging portion 42.

Furthermore, FIG. 3(*d*) illustrates an example where a tip portion 46 in the inserting direction into the torque limiter 20 has an R shape in the axial direction of the holding shaft 30. Any of the protruding portion of the rotation restricting portion 40 in FIG. 3(*b*), FIG. 3(*c*) and FIG. 3(*d*), as similar to the rotation restricting portion 40 shown in FIG. 3(*a*), have the same shape of the holding shaft 130 with the parallel pin 131 of the comparative example attached in the comparative example shown in FIG. 5. Therefore, the engaging portions 42 shown in FIG. 3(*b*), FIG. 3(*c*) and FIG. 3(*d*) have the same function as the parallel pin 131 which is the rotation restricting portion in the comparative example.

[Configurations of Outer Circumferential Portion]

As shown in FIG. 3(*a*), the outer circumferential portion 43 is projected from the shaft diameter portion 31 of the holding shaft 30 that is inserted into the through hole 20*e* (FIG. 2(*b*)) of the torque limiter 20 to the outer diameter direction and is formed so as to go around the outer circumference of the holding shaft 30. The outer circumferential portion 43 is connected (continuous) with the tip portion 41 projected in the inserting direction of the torque limiter 20 and the two protruding portions each having the engaging portion 42. The outer circumferential portion 43 has a shape with a larger shaft diameter than the shaft diameter portion 31 of the holding shaft 30 with which the torque limiter 20 engages, so that the volume increases more than the engaging portion 42 of the protruding portion.

The holding shaft 30 in the embodiment is formed by forging. Therefore, by increasing the volume by providing the outer circumferential portion 43 with an upset forging that enlarges the shaft diameter like the outer circumferential portion 43, it is facilitated to supply the material to be forged to the engaging portion 42.

(Other Shapes of Outer Circumferential Portion)

Figure 4:
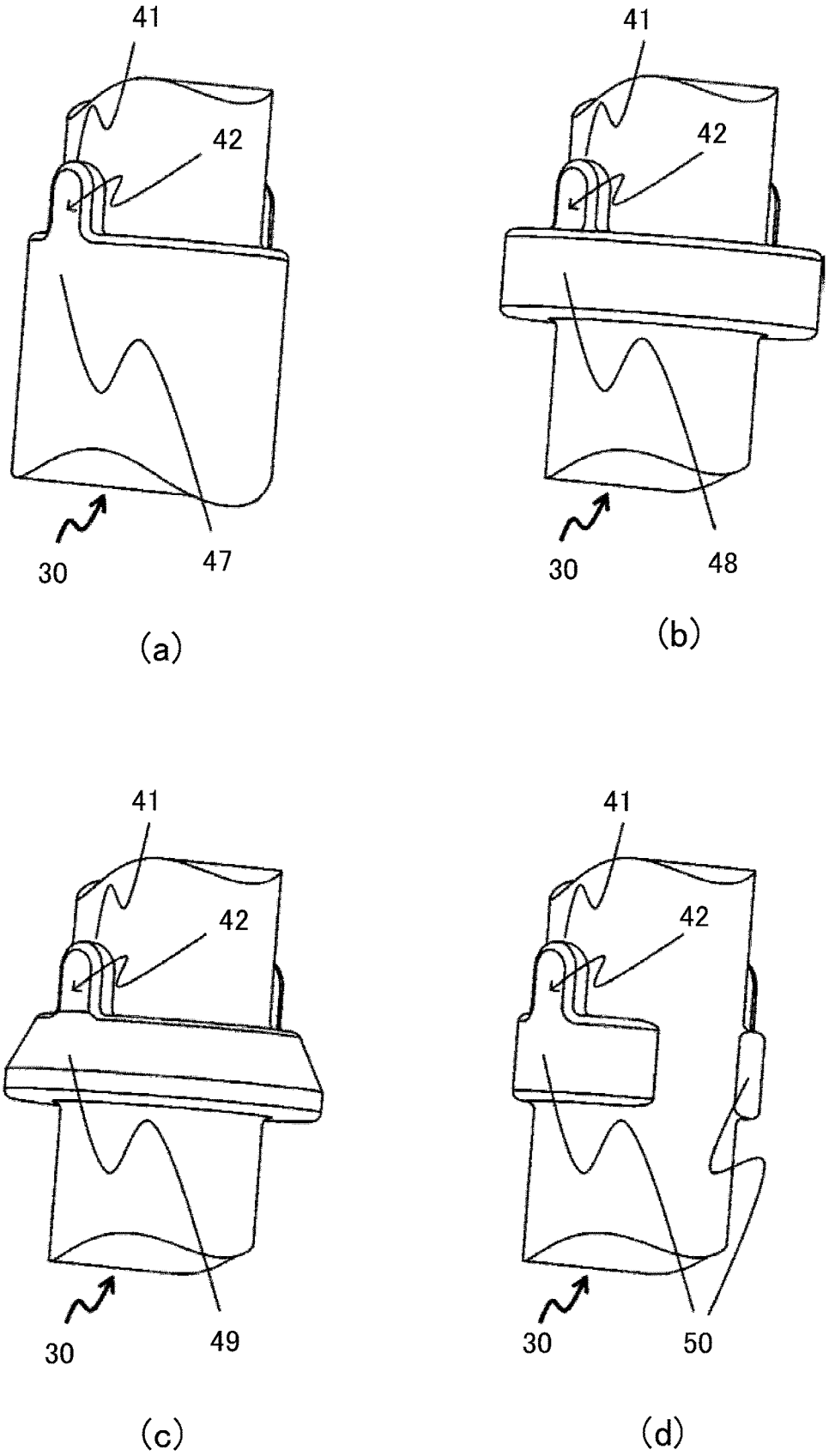
FIG. 4, part (a), part (b), part (c) and part (d), is a schematic view illustrating the rotation restricting portion of the holding shaft in the embodiment.

Incidentally, the shape of the outer circumferential portion 43 is not limited to the shape shown in FIG. 3(*a*). For example, in FIG. 4(*a*), an example is shown where an outer circumferential portion 47 has a shape that is longer in the axial direction of the holding shaft 30 than the outer circumferential portion 43 in FIG. 3(*a*). In addition, in FIG. 4(*b*), an example is shown where an outer circumferential portion 48 has a larger shaft diameter than that of the engaging portion 42 of the protruding portion, and a step is provided between the outer circumferential portion 48 and the engaging portion 42 of the protruding portion. Furthermore, in FIG. 4(*c*), an end portion connected to the engaging portion 42 of the protruding portion of an outer circumferential portion 49 has the same shaft diameter (height in the axial direction of the holding shaft 30) as the engaging portion 42. On the other hand, a shaft diameter of an end portion disposed of a further side from the engaging portion 42 of the protruding portion of the outer circumferential portion 49 is larger than that of the engaging portion 42 of the protruding portion. Therefore, FIG. 4(*c*) shows an example of a shape with an inclined surface tilted toward the engaging portion 42. And, in FIG. 4(*d*), an example is shown where, unlike the outer circumferential portion 47, the outer circumferential portion 48, and the outer circumferential portion 49 that go around the holding shaft 30 as described above, an outer circumferential portion 50 is connected to the protruding portion, has an outer circumferential length that is only a portion of the outer circumferential length of the holding shaft 30, and has two divided shapes.

In the foregoing, the embodiment in which the holding shaft 30 with the rotation restricting portion 40 having a similar shape of a parallel pin is mounted on a torque limiter 20 has been described. Since the rotation restricting portion 40 in the embodiment is formed on the holding shaft 30 by forging, machining of the holding shaft is not necessary as in the case of using the parallel pins in the comparative example, and machining costs can be reduced. Furthermore, in the embodiment, by inserting the holding shaft 30 directly into the through hole 20*e* of the torque limiter 20, the protruding portion of the rotation restricting portion 40 of the holding shaft 30 engages with the engaging portion 20*c* and the engaging portion 20*d* of the torque limiter 20. Therefore, no operation is required at a time of assembly as in the case of using the parallel pins in the comparative example, and assembly costs can be reduced.

Incidentally, in the embodiment, the torque limiters are used as an example of a component for restricting a rotation using parallel pins, but the component is not limited to the torque limiters, and the forging shaft itself can also be applied to both fixed and rotating shafts.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-068356 filed Apr. 18, 2022, which is hereby incorporated by reference herein in its entirety.

What is claimed is:

1. A shaft on which a torque limiter, applying a constant rotational load to a rotatable member attached to the torque limiter during rotation of the rotatable member, is mounted, the shaft comprising:

a rotation restricting portion inserted into and engaged with counterpart engaging portions of the torque limiter to restrict rotation of the torque limiter, wherein the rotation restricting portion is provided with an outer circumferential portion which is projected in an outer diameter direction from an outer circumference of the shaft and of which an outer circumferential surface is formed parallel with an outer circumferential surface of the shaft, and at least a pair of engaging portions connected to the outer circumferential portion and engaging with the counterpart engaging portions of the torque limiter, wherein the pair of the engaging portions are provided in positions opposite to each other with respect to a center of the shaft, wherein a tip portion of each of the pair of the engaging portions has a semicircular cylindrical shape of which diameter is widthwise, wherein a height of the outer circumferential surface of the outer circumferential portion from the outer circumferential surface of the shaft is the same height of the pair of engaging portions of the rotation restricting portion from the outer circumferential surface of the shaft, wherein each engaging portion of the pair of engaging portions of the rotation restricting portion is provided with the tip portion having a R shape opposing one of the counterpart engaging portions of the torque limiter, and a width thereof in a direction perpendicular to an inserting direction into the one of the counterpart engaging portions of the torque limiter is a width capable of being inserted into the one of the counterpart engaging portions of the torque limiter, and wherein the outer circumferential portion of the rotation restricting portion is divided into separated outer portions that are connected to the pair of engaging portions of the rotation restricting portion and are not connected to each other.

2. The shaft according to claim 1 wherein the outer circumferential surface of the outer circumferential portion goes around the outer circumferential surface of the shaft.

3. An image forming apparatus comprising:

a pair of rotational members configured to convey sheets fed from a cassette to accommodate the sheets, wherein the pair of rotational members include a first rotational member configured to convey the sheet fed and a second rotational member, opposite to the first rotational member, configured to separate the sheets one by one, and wherein the torque limiter mounted on the shaft according to claim 1 is attached to the second rotational member.

* * * * *